US005647289A

United States Patent [19]

Young et al.

[11] Patent Number: 5,647,289

[45] Date of Patent: Jul. 15, 1997

[54] PERIMETER SEWING SYSTEM

[75] Inventors: James R. Young, Gainesville, Ga.; Randy Messer, Wellford, S.C.

[73] Assignee: The Needle Doctor, Inc., Wellford, S.C.

[21] Appl. No.: 643,183

[22] Filed: May 6, 1996

[51] Int. Cl.[6] ..... D05B 13/00; D05B 21/00; D05B 27/10

[52] U.S. Cl. ..... 112/10; 112/470.07; 112/470.17; 112/470.18; 280/743.1

[58] Field of Search ..... 112/470.07, 470.06, 112/470.17, 470.09, 470.04, 470.14, 470.18, 475.04, 475.08, 10, 14, 308, 309, 311; 280/728.1, 743.1

[56] References Cited

U.S. PATENT DOCUMENTS 4,989,525 2/1991 Portilla ..... 112/470.07 X
5,018,462 5/1991 Brocklehurst ..... 112/470.07
5,024,174 6/1991 Ferguson ..... 112/470.17
5,174,227 12/1992 Frye et al. ..... 112/10

*Primary Examiner*—Peter Nerbun
*Attorney, Agent, or Firm*—Quarles & Brady

[57] ABSTRACT

A perimeter sewing system for manufacture of a self-inflating vehicle air bag includes: a base structure and a rotatable lower platter mounted in said base structure. A rotatable upper platter is mounted to a support arm attached to said base. The lower platter and the upper platter have a common axis of rotation. A primary motor is also included. A sewing machine is positioned for perimeter sewing of fabric placed on the lower platter. The sewing machine is mechanically synchronized with the primary motor. Drive structure is provided for driving the lower platter at a user-variable rotational speed which is synchronized with the said primary motor. This drive structure includes a forward/reverse transmission. A sensor means is provided for detecting a position of said lower platter. A processor receives inputs from a control panel and the sensor to control the primary motor, the platter reverse motor, and the forward/reverse transmission means.

12 Claims, 4 Drawing Sheets

PERIMETER SEWING SYSTEM

BACKGROUND OF THE INVENTION

1. Field of the Invention

The invention relates generally to perimeter sewing systems, and more particularly to perimeter sewing systems for vehicle air bags.

2. Description of the Prior Art

The increasing popularity of air bags in motor vehicles has brought about a dramatic increase in the manufacturing demand for such products. At the same time that the popularity of such products has soared, there has emerged a need to devise manufacturing methods which reduce the manufacturing time and cost. One of the major manufacturing operations associated with fabricating air bags involves a perimeter stitching operation which attaches a front and rear fabric panel together to form the basic air bag. This perimeter stitching operation has created some difficulties because of certain manufacturing specifications which must be adhered to, as well as the nature of the fabric materials involved.

With respect to the manufacturing specifications, it is commonly required that air bags be perimeter stitched to very exacting requirements. These requirements include such things as the number of stitches per inch, the distance of the stitches from the perimeter edge of the materials being sewn, and overstitch requirements (which relate to perimeter stitching slightly more than 360 degrees around the bag perimeter). The types of materials involved have led to problems on the part of bag fabricators with meeting such requirements, in part, because the materials tend to have a surface which is somewhat slippery, with the result that the sewing process can sometimes lead to bunching of the fabric, misalignment of fabric panels, and undesirable pleating.

In order to solve the various problems presented by the air bag fabrication process, perimeter sewing systems have been developed which make use of rotating platters on which a pair of fabric panels are placed and then stitched together around their perimeter. Usually, a pair of platters is used, with one lower platter forming a base or support, and a second upper platter compressing against the lower platter in order to position the air bag panels therebetween. In order to meet the stringent manufacturing specifications associated with air bags, such perimeter sewing systems have typically used a plurality of stepper motors for separately driving the platters and the sewing machine. The stepper motors have been electronically synchronized so that the rotation of the platter and the sewing machine stitching action result in a perimeter stitching system which meets the requirements for number of stitches per inch, overstitching, etc.

While such prior art systems have met with some success, they have been found to present severe maintenance problems due to their rather complex nature. Also, because such systems have been digitally controlled and involve the use of multiple stepper motors operating at relatively high speeds, it has proved difficult to fully achieve the necessary degree of synchronization. For example, the process of synchronization for a given size air bag has necessitated that technicians manually input a set of synchronization control parameters and then perform test runs to determine whether proper synchronization has been achieved. Thus it has proved time consuming and, in some cases, nearly impossible to achieve proper synchronization using such systems.

Recently, the problem of synchronization has become of greater difficulty due to the use of certain new types of air bag materials such as 420 denier uncoated, 630 denier uncoated, 420 silicone nylon and 420 neoprene nylon offered by Reeves International and Milliken. Although the precise reason is not entirely clear, such fabrics have proved extremely difficult to use with perimeter stitching systems of the prior art. Such attempts have resulted in bunching and pleating of fabric as well as an inability to accurately control the number of stitches per inch for various size bags.

It would be desirable to provide a perimeter stitching system which avoids the maintenance problems which have plagued multiple step motor systems of the prior art which are electronically synchronized. It would be further desirable to provide a perimeter stitching system which allows continuous "on the fly" adjustment of synchronization between sewing machine stitch rate and platter rotation.

SUMMARY OF THE INVENTION

A mechanically synchronized perimeter sewing system for manufacture of a self-inflating vehicle air bag is provided. The system is controlled by an operator control panel and a processor unit which is preferably a programmable logic controller. The system comprises a base structure with a table or work surface. A rotatable lower platter is mounted in the base structure and a rotatable upper platter is mounted to a support arm which is also attached to the base structure. When the device is operated, the upper platter compresses against the lower platter to maintain in position therebetween a pair of fabric panels which will be used to form a completed air bag. The upper and lower platter have a common axis of rotation. For the purpose of allowing workers or machines to insert and remove fabric panels for perimeter stitching, the support arm is designed to pivot with respect to the work surface and the upper platter is capable of moving, for example on a track, on the support arm.

A sewing machine is provided which includes a sewing machine main drive shaft. The sewing machine is preferably positioned along a peripheral portion of the lower platter for perimeter sewing of fabric which has been positioned on the lower platter. A primary motor and a platter reverse motor are provided for driving the invention. A primary motor output shaft is rotatably connected to the sewing machine main drive shaft and is mechanically synchronized therewith, preferably by means of a toothed timing belt. For the purposes of this invention, the term "synchronization" shall refer to a rotational drive system wherein a specified angular rotational movement of an input shaft results in an angular rotational movement of an output shaft which is precisely related to the input angular rotational movement by a constant ratio. The ratio may be varied by an operator but, once set, should not vary over time.

A synchronized, continuously variable motor speed reducer is provided to vary the lower platter rotational speed relative to the sewing machine speed, thereby allowing the platter rotational speed to be varied but remain precisely synchronized with the sewing machine drive shaft. The motor speed reducer preferably has a speed reducer input shaft rotatably connected to the primary motor output shaft. A speed reducer output shaft is also preferably provided. A control knob is provided for controlling the motor speed reducer, thereby allowing an operator to vary the rotational speed of the speed reducer output shaft relative to the speed reducer input shaft. In a preferred embodiment, the speed reducer is a purely mechanical device to ensure precise mechanical synchronization of the input and output shaft.

The speed reducer is mechanically synchronized with said primary motor output shaft by virtue of the direct mechanical link between the two units. A platter transmission unit is provided for controlling forward and reverse direction of the lower platter. The speed reducer output shaft is rotatably connected to a platter transmission unit input shaft. A platter transmission unit output shaft is preferably rotatably connected to the lower platter through a torque converter. In this way, the lower platter is mechanically synchronized with the primary motor output shaft.

One or more sensors is provided for detecting a home position of the lower platter. In a preferred embodiment, the programmable logic controller receives inputs from the control panel and the sensor (or sensors) for controlling the primary motor, the platter reverse motor and the platter transmission unit. The platter transmission unit controls forward and reverse rotation of the lower platter by switching gears between the output shaft of the speed reducer and the platter reverse motor. A setable motor timer is provided on the control panel for varying the degree of overstitch beyond a 360 degree perimeter.

BRIEF DESCRIPTION OF THE DRAWINGS

There are shown in the drawings embodiments which are presently preferred it being understood, however, that the invention is not limited to the precise arrangements and instrumentalities shown, wherein.

DETAILED DESCRIPTION OF THE PREFERRED EMBODIMENTS

Figure 1:
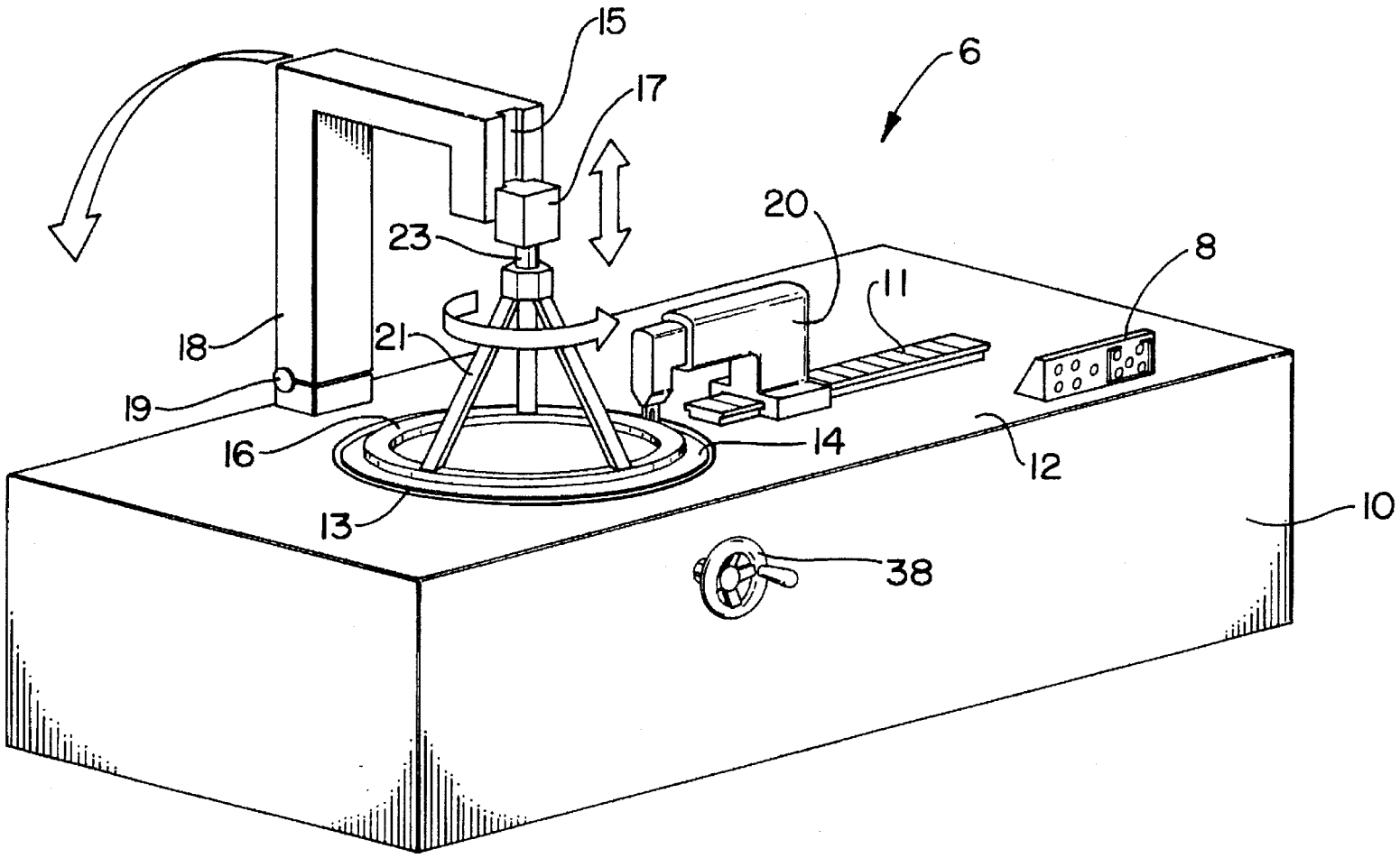
FIG. 1 is a perspective view of a perimeter stitching system according to the invention.

Referring to FIG. 1, there is shown a perimeter sewing system according to the invention. The system 6 includes a base 10 which preferably has a table or work surface 12. A control panel 8 is preferably mounted on or adjacent to the base structure for allowing convenient operation of the system by a user. Rotatably positioned within an aperture 13 is a lower platter 14 which is essentially a turntable for supporting a front and back pair of circular air bag fabric panels which are to be perimeter sewn to define an air bag (not shown). A sewing machine 20 is provided to perform automatic fabric stitching operations.

A rotatable upper platter 16 is provided to compress against the lower platter 14 so as to maintain in position therebetween the pair of air bag fabric panels. The upper and lower platter are advantageously designed to have a common axis of rotation and are designed to rotate together on said axis.

The upper platter 16 may be mounted in position above the lower platter by any suitable structure such support arm 18 which is attached to the base structure 10. The upper platter 16 is rotatably attached to the support arm 18 by means of struts 21 and platter shaft 23.

In a preferred embodiment means are provided to conveniently disengage the upper platter from the lower platter to facilitate placement and removal of air bag fabric panels on the lower platter. For example, as shown in FIG. 1, the support arm may be attached to the base structure by means of a hinge 19 to permit pivot movement as shown by the arrow in FIG. 1. In such case, the support arm 18 may be manually pivoted on hinge 19 by an operator or, in a preferred embodiment, may be automatically pivoted at an appropriate time. Such automatic pivoting action may be effected by any suitable electromechanical, hydraulic or pneumatic means. In a preferred embodiment, the support arm 18 is operated by an electronically controlled pneumatic piston (not shown) which can be attached to the support arm 18 and the base structure 10. Further, as shown by the arrows in FIG. 1, the upper platter 16 may be advantageously designed for positional movement relative to the support arm 18. In a preferred embodiment, the platter is mounted to a car 17 which rides in a track 15 formed on the support arm 18. Once again, such movement may be effected manually by an operator or by suitable electromechanical, hydraulic or pneumatic means. In a preferred embodiment, the car 15 is moved automatically by an electronically controlled pneumatic piston.

Figure 2:
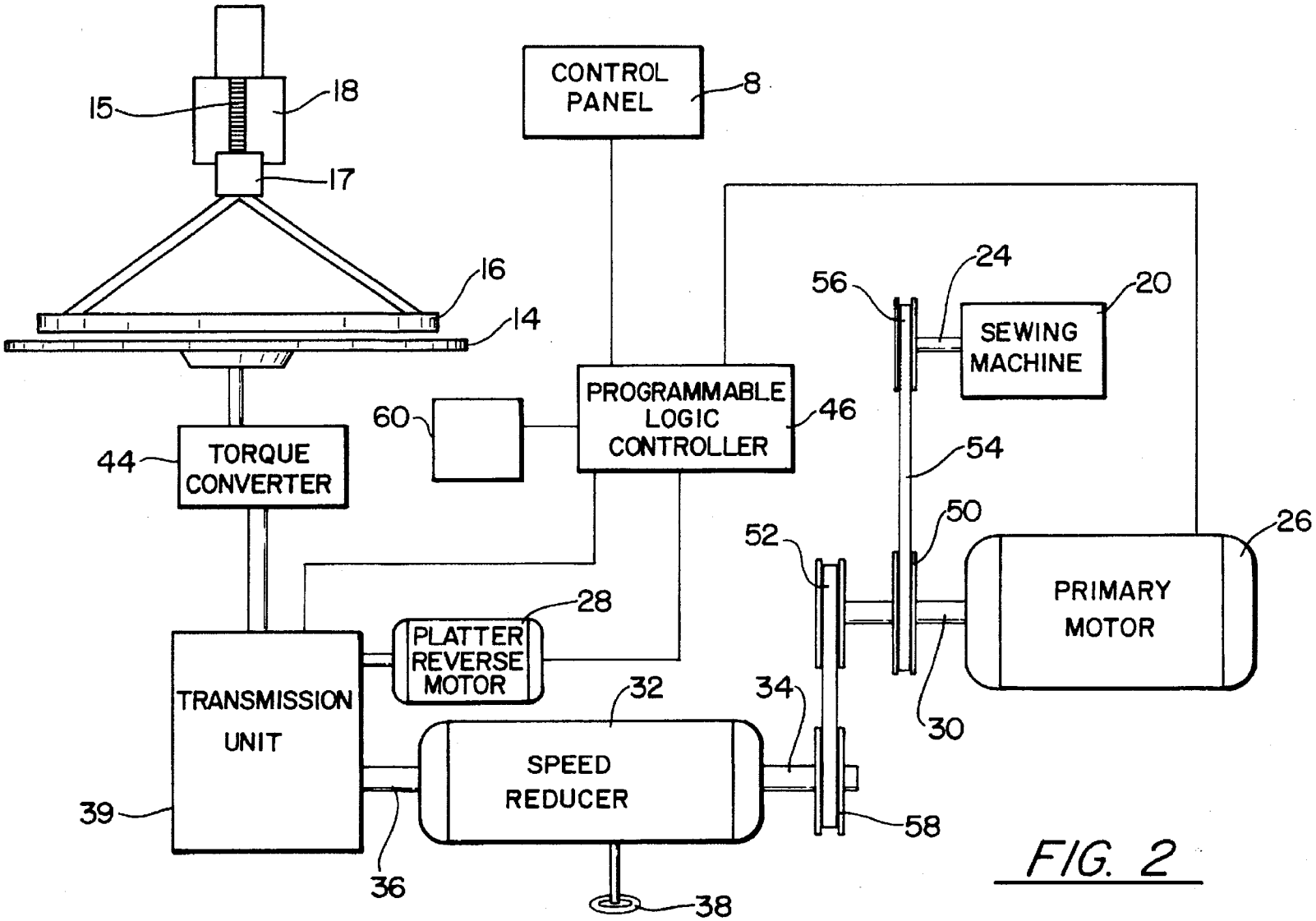
FIG. 2 is a schematic diagram showing the perimeter stitching system of FIG. 1.

Sewing machine 20 is advantageously positioned so that needle 25 can engage a periphery of a pair of circular air bag fabric panels to be stitched together on the system. In order to conveniently accommodate air bag panels of various different sizes, the sewing machine 20 can be mounted on a guide track 11 which may be oriented radially relative to the upper and lower platters. A locking mechanism (not shown) can also be provided to maintain the sewing machine 20 in a stationary location once it has been properly positioned. As shown in FIG. 2, the perimeter sewing system is controlled by a central processor unit such as programmable logic controller 46. The programmable logic controller receives inputs from the system and from the control panel 8. As described below, the rotational speed of the lower platter 14 is precisely synchronized with the stitching rate of sewing machine 20 to allow improved performance, while simultaneously reducing complexity over conventional perimeter stitch machines utilizing stepper motors.

Primary motor 26 is provided to supply a forward rotational drive force for lower platter 14 and sewing machine 20. Platter reverse motor 28 is provided to provide a reverse rotational drive force for lower platter 14. Both primary motor 26 and platter reverse motor 28 are controlled by programmable logic controller 46. In a preferred embodiment, primary motor 26 is a an AC servo motor and generally must be powerful enough to drive sewing machine 20 and lower platter 14. A ½ horsepower AC servo motor has been found to be suitable for this purpose.

Primary motor 26 is connected via separate mechanical drive trains to sewing machine 20 and lower platter 14. A fixed drive ration is preferably employed for the sewing machine 20 while a variable speed synchronized drive train is advantageously used to rotate the lower platter 14. With respect to sewing machine 20, any fixed ratio mechanical system may be used to impart a rotational force. For example, a gear drive, a chain drive or a flexible (V) belt drive may be used for this purpose.

In a preferred embodiment, primary motor output shaft 20 is provided with a pulley 50 mounted thereto. Pulley 50 drives sewing machine pulley 56 by means of a (V) belt which has been sufficiently tensioned to avoid slippage. In this manner, the rotation of the sewing machine main drive shaft 24 will be precisely synchronized with the rotation of primary motor shaft 30. An acceptable ratio for pulley 50 relative to pulley 56 has been found to be approximately 0.85:1.

As noted above, the drive train for the lower platter 14 is a synchronized system which ensures that the rotation speed of the lower platter 14 is precisely synchronized to the primary motor output shaft 30. Further, the drive train preferably includes means for speed reducing the rotation of the lower platter 14 in a continuous (not stepped) manner. In this manner, the platter may be rotated at such a rate, relative to the operation of the sewing machine 20, that a specified number of stitches per inch are performed on a periphery of a pair of air bag fabric panels positioned on the lower platter 14.

In a preferred embodiment, the platter drive system is comprised of a purely mechanical linkage. The system is rotatably driven by the primary motor output shaft 30 by means of a pulley 52. More specifically, pulley 52 drives a pulley 58 by means of a gear belt, i.e. a flexible belt having timing teeth which engage corresponding grooves in each of pulley 52 and 58. Alternatively, a direct gear drive or chain drive could be used for this purpose. Pulley 58 is attached to an input shaft 34 of mechanical speed reducer 32. An acceptable pulley ratio for pulley 52 to pulley 58 has been determined to be 1.36 to 1.

The speed reducer 32 may be any of several suitable type systems which are commercially available, including model no. JK-11 available from Zero Max, Inc. The speed reducer 32 allows the speed of output shaft 36 to be continuously reduced relative to the input shaft 34 by means of a mechanical control knob 38. The output shaft 36 of speed reducer 32 drives an input shaft of forward/reverse transmission unit 39.

Transmission unit 39 is electronically controlled by programmable logic controller 46 in order to cause lower platter 14 to rotate in either a forward or reverse direction. When the platter is to be rotated in a forward direction, the transmission causes torque converter 44 to be driven by speed reducer output shaft 36 through simple gearing. Conversely, when lower platter 14 is to be driven in a reverse direction, the transmission unit causes torque converter 44 to be driven by platter reverse motor 28 through a simple gear drive. Torque converter 44 is provided to increase the torque available for driving lower platter 14. A drive ratio of 60:1 for the torque converter has been found to produce acceptable results for rotating lower platter 14.

As an example of the relative rotational rates of the primary motor and the platter, primary motor 26 typically operates at a rotational speed of about 3400 RPM. This results in a rotational speed of speed reducer input shaft 34 of about 2500 RPM. If the speed reducer control knob 38 is set such that the speed reducer output shaft 36 has a rotational speed of 240 RPM, the resultant platter final drive speed will be about 4 RPM.

Programmable logic controller 46 is electronically connected to an actuator control unit 60. Actuator control unit 60 responds to electronic commands received from the programmable logic controller 46 to control electromechanical, hydraulic or pneumatic actuating devices for pivoting support arm 18 and moving car 17 relative to the support arm 18. In a preferred embodiment, pneumatic actuating pistons (not shown), such as the 45A Series available from Mac, Inc., are used for this purpose.

Input sensors are provided to allow the programmable logic controller 46 to determine at least a home position of lower platter 46. In a preferred embodiment, a normally open magnetic reed proximity sensor switch 62*a*, 62*b* is provided for this purpose on lower platter 14 and along the periphery of aperture 13. The proximity sensor switch 62*a,b* allows the programmable logic controller to detect when the lower platter is at a home position. For each sew cycle, the proximity switch will close when the lower platter has completed a 360 degree rotation and the two components of the proximity switch 62*a,b* are moved to a position adjacent to one another by action of the lower platter rotation.

Figure 3:
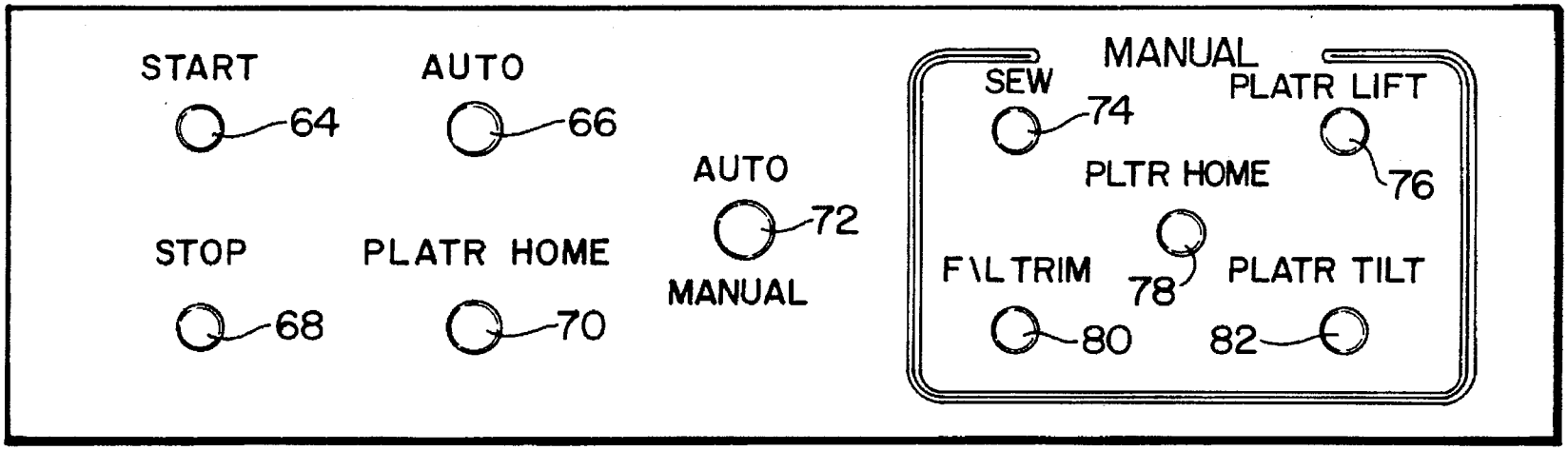
FIG. 3 is a plan view of a control panel for the perimeter stitching system of FIG. 1.
Figure 4:
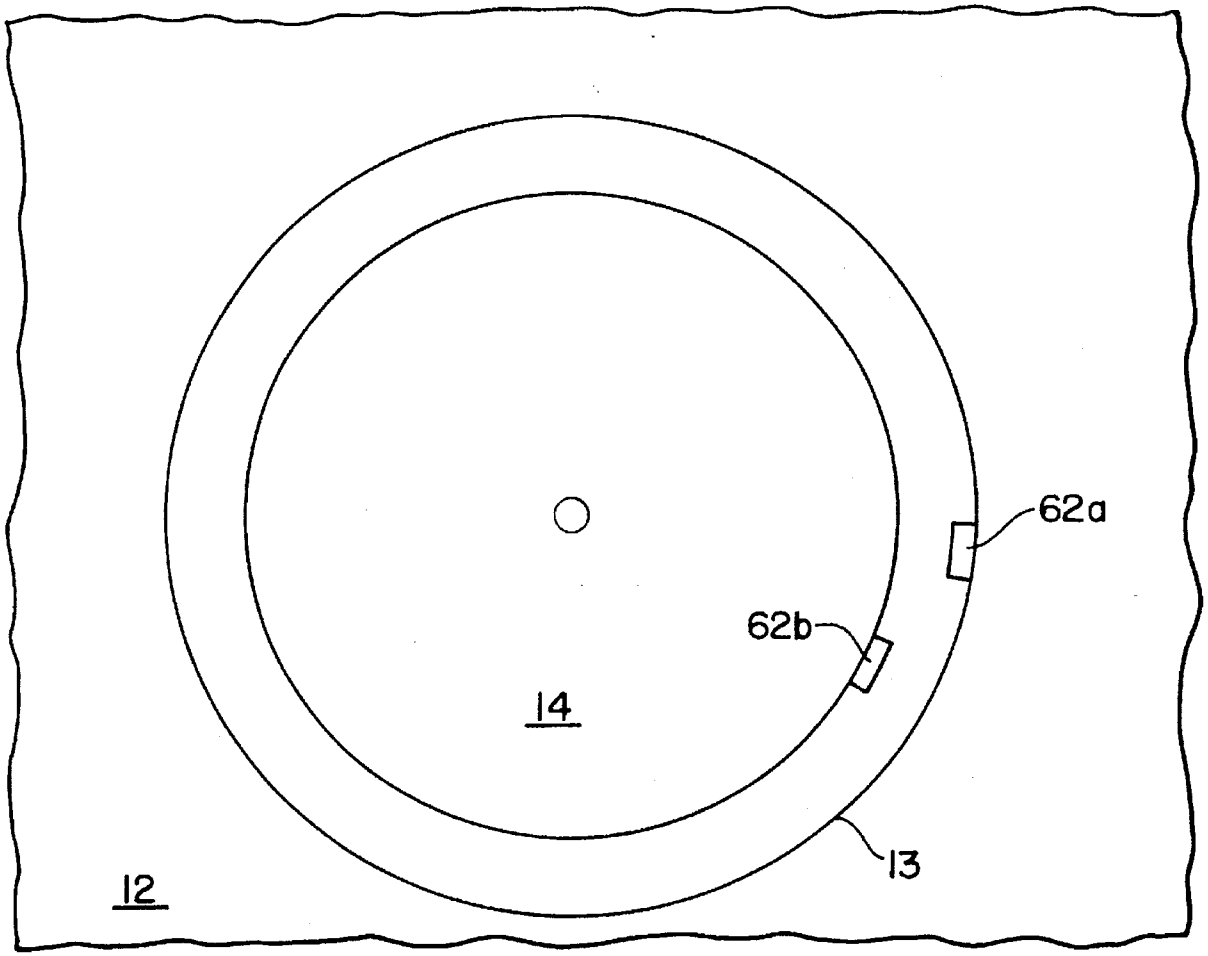
FIG. 4 is a top view of the lower platter showing a proximity sensor switch.

As shown in FIG. 3, control panel 8 preferably includes a start switch 64, an auto switch 66, a stop switch 68 and a platter home switch 70. In addition, an auto/manual switch 72 is provided to enable a second set of manual switch controls including a sew switch 74, a platter lift switch 76, a platter home switch 78, an F/L trim switch 80 and a platter tilt switch 82. In order to facilitate satisfaction of oversew requirements, which are common to air bags, an electronic timer is also provided to enable an operator to set a length of time the perimeter sewing system is to continue stitching an air bag after the proximity switch has indicated that the platter has rotated through 360 degrees. By setting the timer for a specific length of time, an operator can vary the additional angle past 360 degrees which the system will continue to stitch before finally completing a perimeter stitch cycle. The timer electronically communicates with the programmable logic controller 46 to indicate the end of the oversew time period.

The operation of the invention will now be described. Upon initial power up of the system, the start switch is toggled. This action causes the car 17 to rise in its track, thereby lifting upper platter 16. It also causes support arm 18 to tilt up and away from the lower platter 14. At this time the lower platter may be rotated to a home position by operation of the manual platter home switch 78. Operation of the manual platter home switch switches the transmission unit into reverse and activates platter reverse motor 28. As a result, the lower platter 14 is caused to rotate in a reverse direction until the proximity sensor 62*a, b* is activated. A pair of front and rear air bag panels to be perimeter stitched may be loaded onto lower platter 14 when the support arm 18 and upper platter 16 are in their tilted and raised position, respectively.

Once the air bag panels have been loaded, the auto switch 66 is toggled to begin an automatic perimeter stitching cycle. The support arm 18 will tilt forward and the upper platter 16 will be lowered by operation of car 17 on its track. The primary motor 26 will be energized, causing the sewing machine 20 to begin operation simultaneously with the rotation of lower platter 14. Upper platter 16 will rotate freely with lower platter 14 against which it is engaged. After the sewing machine has made a complete circle (360 degrees), the oversew timer will cause the unit to continue sewing beyond 360 degrees, until the operator set time value has expired. The lower platter 14 will then stop rotating and the sewing machine will simultaneously stop sewing. The programmable logic controller 46 will engage the platter reverse motor 28 and switch the transmission unit 39 to reverse to return the lower platter 14 to its home position as indicated by the closing of the proximity sensor switch 62*a,b*. Finally, the upper platter 16 will be raised and the support arm 18 tilted by a command from the programmable logic controller 46 to the actuator control unit 60. The unit is then ready for the next sew operation.

As the invention can be embodied in other specific forms without departing from the spirit or essential attributes thereof, reference should be made to the following claims, rather that to the foregoing specification, as indicating the scope of the invention.

We claim:

1. A perimeter sewing system for manufacture of a self-inflating vehicle air bag said system comprising:

a base structure having a table surface;

a programmable logic controller and an operator control panel;

a rotatable lower platter mounted in said base structure;

a rotatable upper platter mounted to a support arm attached to said base structure, said lower platter and said upper platter having a common axis of rotation;

a primary motor and a platter reverse motor;

a sewing machine having a main drive shaft, said sewing machine positioned along a peripheral portion of said lower platter for perimeter sewing fabric positioned on said lower platter;

a primary motor output shaft rotatably connected to said sewing machine main drive shaft and mechanically synchronized therewith;

a continuously variable mechanically operated motor speed reducer, said motor speed reducer having a speed reducer input shaft rotatably connected to said primary motor output shaft, a speed reducer output shaft, and a control knob for allowing an operator to mechanically vary the rotational speed of the speed reducer output shaft relative to the speed reducer input shaft;

said speed reducer output shaft mechanically synchronized with said primary motor output shaft;

a platter transmission unit, said speed reducer output shaft rotatably connected to a platter transmission unit input shaft, a platter transmission unit output shaft rotatably connected to said lower platter through a torque converter, said lower platter mechanically synchronized with said primary motor output shaft;

a sensor for detecting a home position of said lower platter;

said programmable logic controller receiving inputs from said control panel and said sensor for controlling said primary motor, said platter reverse motor and said platter transmission unit.

2. A perimeter sewing system for manufacture of a self-inflating vehicle air bag said system comprising:

a base structure;

a rotatable lower platter mounted in said base structure;

a rotatable upper platter mounted to a support arm attached to said base, said lower platter and said upper platter having a common axis of rotation;

a primary motor;

sewing machine means, said sewing machine means positioned for perimeter sewing of fabric placed on said lower platter, said sewing machine mechanically synchronized with said primary motor;

mechanical means for driving said lower platter at a user variable rotational speed, said mechanical means being synchronized with said primary motor, said mechanical means including a forward/reverse transmission means;

sensor means for detecting a position of said lower platter;

a control panel;

processor means for receiving inputs from said control panel and said sensor for controlling said primary motor, said platter reverse motor and said forward/reverse transmission means.

3. The perimeter sewing system according to claim 2 wherein said processor means is a programmable logic controller.

4. The perimeter sewing system according to claim 2 wherein said sewing machine means includes a sewing machine head positioned along a peripheral portion of said lower platter for perimeter sewing fabric positioned on said lower platter.

5. The perimeter sewing system according to claim 2 wherein said primary motor includes a primary motor output shaft, said sewing machine means includes a main drive shaft, and said primary motor output shaft is rotatably connected to said sewing machine main drive shaft and mechanically synchronized therewith.

6. The perimeter sewing system according to claim 5 wherein said mechanical means includes a continuously variable mechanical motor speed reducer for controlling a platter rotational speed.

7. The perimeter sewing system according to claim 6 wherein said motor speed reducer has a speed reducer input shaft rotatably connected to said primary motor output shaft, a speed reducer output shaft, and a control knob for allowing an operator to mechanically vary the rotational speed of the speed reducer output shaft relative to the speed reducer input shaft.

8. The perimeter sewing system according to claim 7 wherein said speed reducer output shaft is mechanically synchronized with said primary motor output shaft.

9. The perimeter sewing system according to claim 8 wherein said transmission means includes a transmission means input shaft, a transmission means output shaft, and a speed reducer output shaft is rotatably connected to said transmission means input shaft.

10. The perimeter sewing system according to claim 9 wherein said transmission means output shaft is rotatably connected to said lower platter through a torque converter, and said lower platter is mechanically synchronized with said primary motor output shaft.

11. The perimeter sewing system according to claim 2 further comprising a platter reverse motor having a reverse motor output shaft rotatably connected to said transmission means.

12. The perimeter sewing system according to claim 11 wherein said programmable logic controller receives inputs from said control panel and said sensor means for controlling said primary motor, said platter reverse motor and said platter transmission unit.

* * * * *